US006637351B1

(12) United States Patent
Brennan, Jr. et al.

(10) Patent No.: US 6,637,351 B1
(45) Date of Patent: Oct. 28, 2003

(54) SHIPPING PALLET WITH RETRACTABLE RAILS

(75) Inventors: James F. Brennan, Jr., Moorestown, NJ (US); Martin Clive-Smith, Leek Wootton (GB)

(73) Assignee: Lock Nest, L.L.C., East Riverton, NJ (US)

( * ) Notice: Subject to any disclaimer, the term of this patent is extended or adjusted under 35 U.S.C. 154(b) by 0 days.

(21) Appl. No.: 10/143,591

(22) Filed: May 8, 2002

(51) Int. Cl.[7] ..... B65D 19/38
(52) U.S. Cl. ..... 108/54.1; 108/55.1; 108/57.12
(58) Field of Search ..... 108/51.11, 54.1, 108/55.1, 56.3, 57.12, 57.15; 248/346.02, 346.01

(56) References Cited

U.S. PATENT DOCUMENTS

| | | | | | |
|---|---|---|---|---|---|
| 1,129,775 | A | * | 2/1915 | Anthony | 108/54.1 |
| 1,745,046 | A | * | 1/1930 | Romine | 108/54.1 |
| 3,119,357 | A | * | 1/1964 | Kirsch et al. | 108/57.12 |
| 3,523,507 | A | * | 8/1970 | Dubin | 108/57.12 |
| 3,759,192 | A | * | 9/1973 | Oehler | 108/44 |
| 4,911,318 | A | | 3/1990 | Bishop | |
| 5,799,585 | A | * | 9/1998 | Brennan et al. | 108/53.1 |
| 6,173,659 | B1 | * | 1/2001 | Danks et al. | 108/54.1 |
| 6,543,370 | B2 | * | 4/2003 | Bae | 108/55.1 |

FOREIGN PATENT DOCUMENTS

| | | | |
|---|---|---|---|
| JP | 6-92356 | * | 4/1994 |

* cited by examiner

*Primary Examiner*—Jose V. Chen
(74) *Attorney, Agent, or Firm*—Norman E. Lehrer

(57) ABSTRACT

A shipping pallet comprises a rectangular planar base member having two opposing ends and two opposing sides. Pivotally connected to one of the ends of the base member is a handle member that is adapted to be pivoted from a stored position, wherein the handle member is folded on top of the base member, to an operative position, wherein the handle member extends upwardly from the base member. The under surface of the base member includes a pair of elongated spaced apart pockets that extend the length of the base member on either side of the center line thereof. An elongated rail is associated with each of the pockets. Hydraulic rams or other power devices move the rails between a first position wherein they are within the pockets so that the planar base member of the pallet rests directly on a support surface and a second position Where the rails extend downwardly to support the pallet thereon. The pallets and handle members are so configured and dimensioned so that the handle fits between the elongated rails of the pallet positioned directly above or within a recess of that pallet so as not to interfere with the ability to stack a plurality of pallets on top of each other.

10 Claims, 3 Drawing Sheets

SHIPPING PALLET WITH RETRACTABLE RAILS

BACKGROUND OF THE INVENTION

The present invention is directed toward a shipping pallet and, more particularly, to a shipping pallet which includes extendible and retractable rails thereby making the same suitable for use in ships and trucks and in cargo planes and which can be compactly stacked on top of an adjacent pallet when not in use.

In order to transport a plurality of packaged goods it is common to first place the goods on top of an article supporting platform or pallet which includes a substantially planar support surface. Such pallets are required to comply with I.S.O. standards promulgated by the International Standards Organization. U.S. Pat. No. 4,834,000 shows an example of that kind of pallet. Once the pallet is loaded, it is pushed or pulled into a shipping container to be carried by a truck, ship, train or plane. Such pallets are typically rather large and are adapted to support loads of several tons. Accordingly, specialized loading vehicles, e.g. PLS (pallet load and unload system) trucks, are utilized to either push or pull the loaded pallet into the cargo area of the shipping vehicle or container.

Conventional article supporting platforms often include a pair of opposing end walls. U.S. Pat. Nos. 4,099,640, 4,162,737, 4,355,732, 4,638,744, 4,911,318, 4,964,349, 5,275,301, 5,398,832, 5,494,182 disclose examples of such platforms. Others, such as shown in U.S. Pat. No. 5,799,585 utilize an A-shaped handle at one end for moving and manipulating the pallet. The handle can be folded downwardly onto the top of the pallet when the same is not in use and fits between the support rails of a similarly constructed pallet stacked above. The stacking of the platforms is important for the convenient storage and transportation of the same. U.S. Pat. No. 5,799,585 also discloses a system wherein the handle of the lowermost pallet in a stack of pallets can be used to move the entire stack.

Substantially all pallets of the class referred to include supports on the underside thereof in the form of elongated rails that are capable of supporting the pallet and the cargo carried thereby. Most commonly, there are two rails that run the length of the pallet with one on either side of the centerline of the same. The rails typically extend below the bottom of the lower surface of the pallet. There are times, however, when it would be desirable to eliminate the rails so that the platform or pallet could rest directly on the surface of the vehicle carrying the same. This may be the case, for example, on an airplane that included hold down means that operate best if the pallet were resting directly on the floor.

Thus, pallets that are useful for transporting goods on ships or in trucks have less utility on cargo planes. This requires that shipping companies own and use two different types of pallets, i.e. pallets with rails and pallets without rails. No prior art pallet is know to exist that is transformable between a railed pallet and a pallet that functions as if it had no rails.

SUMMARY OF THE INVENTION

The present invention is designed to overcome the deficiencies of the prior art discussed above. It is an object of this invention to provide a pallet which can be easily converted between a railed pallet and a pallet without rails.

It is a further object of the invention to provide a pallet which can easily be transported by a ship or truck or on a cargo plane.

It is yet another object of the invention to provide a pallet which complies with the I.S.O. standards set forth by the International Standards Organization but which can be easily converted between a railed pallet and a railless pallet.

It is a still further object of the invention to provide a pallet which can easily be transported by a ship or truck or on a cargo plane and which can also be stacked and transported when empty.

In accordance with the illustrative embodiments, demonstrating features and advantages of the present invention, there is provided a shipping pallet which comprises a rectangular planar base member having two opposing ends and two opposing sides. Pivotally connected to one of the ends of the base member is a handle member that is adapted to be pivoted from a stored position, wherein the handle member is folded on top of the base member, to an operative position, wherein the handle member extends upwardly from the base member. The under surface of the base member includes a pair of elongated spaced apart pockets that extend the length of the base member on either side of the center line thereof. An elongated rail is associated with each of the pockets. Hydraulic rams or other power devices move the rails between a first position wherein they are within the pockets so that the planar base member of the pallet rests directly on a support surface and a second position where the rails extend downwardly to support the pallet thereon. The pallets and handle members are so configured and dimensioned so that the handle fits between the elongated rails of the pallet positioned directly above or within a recess of that pallet so as not to interfere with the ability to stack a plurality of pallets on top of each other.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
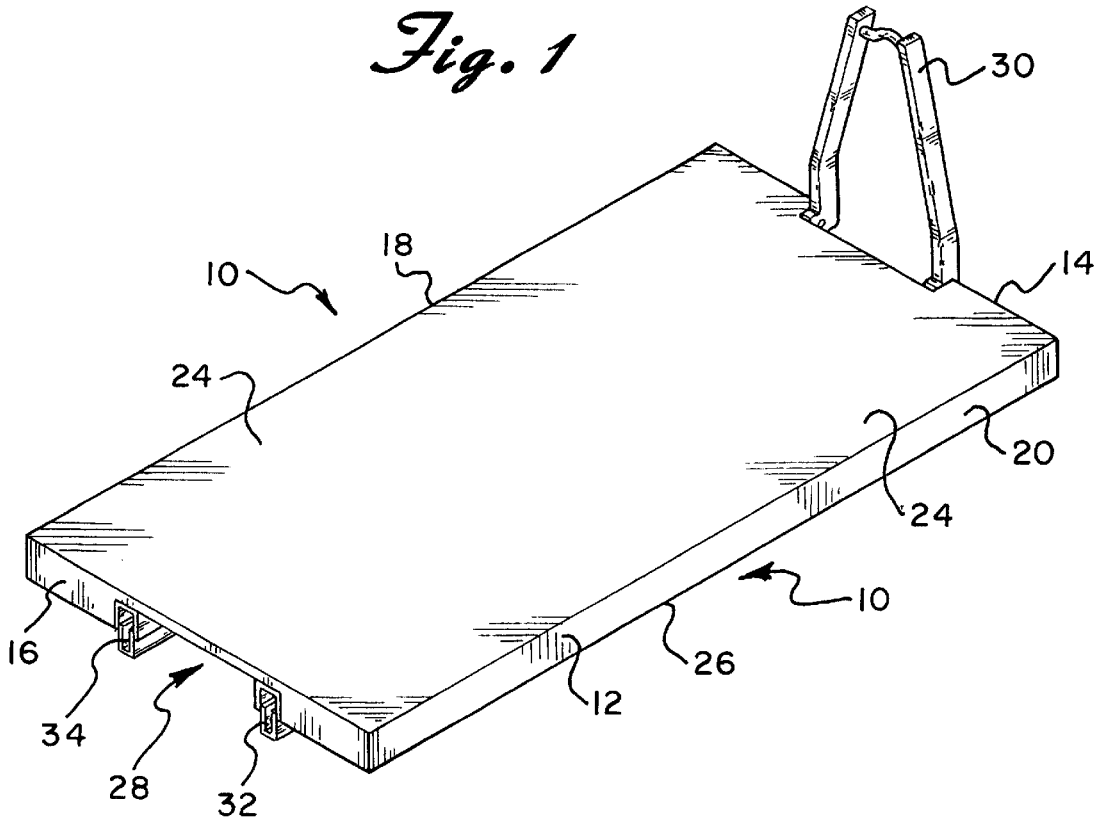
FIG. 1 is a perspective view of a shipping pallet with retractable rails constructed in accordance with the principles of the present invention and showing its handle member in an upright operative position.

Referring now to the drawings in detail wherein like reference numerals have been used throughout the various figures to designate like elements, there is shown in FIG. 1 a shipping pallet with retractable rails constructed in accordance with the principles of the present invention and designated generally as 10.

Figure 2:
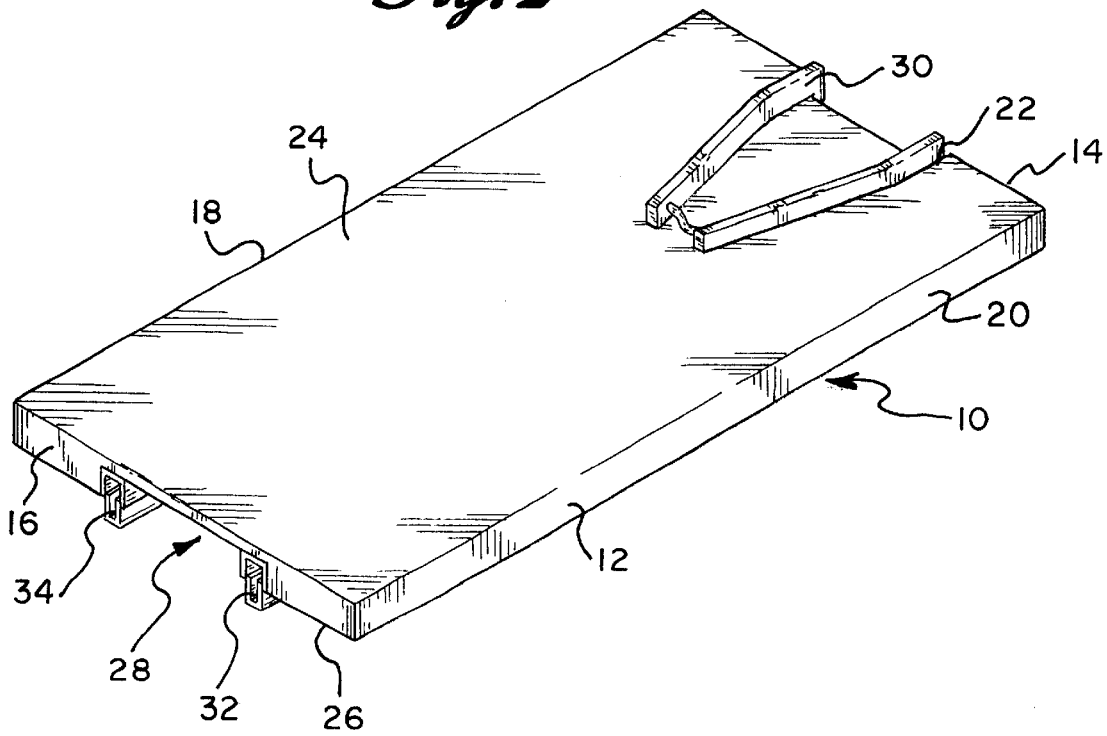
FIG. 2 is a perspective view similar to FIG. 1 but showing the handle member in the lowered inoperative position.
Figure 7:
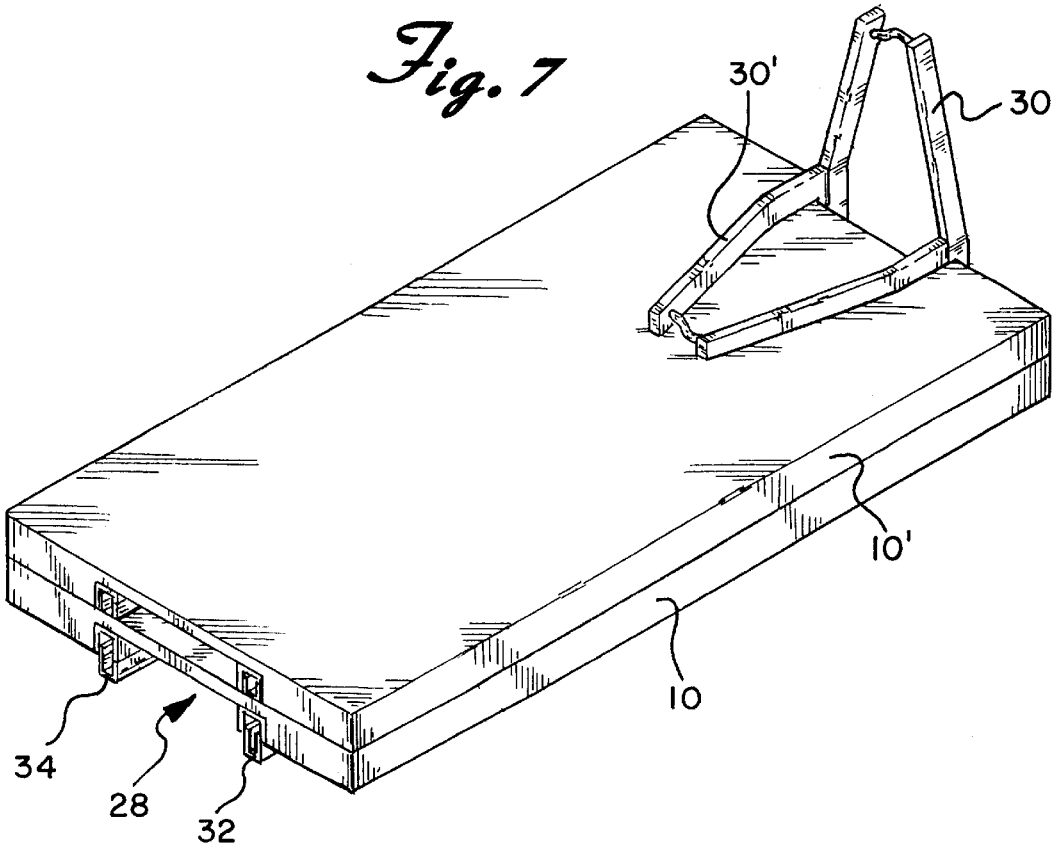
FIG. 7 is a perspective view showing two pallets stacked on top of one another.

The pallet 10 includes a rectangular planar base member 12. The base member has a first end 14, a second end 16, and two opposing sides 18 and 20. Extending into the first end 14 of the base member is 12 is a recess 22. The pallet also includes an upper face 24 and a lower face 26. An elongated recess 28 is formed in the lower face 26 and extends substantially the length of the base member. A handle 30 is pivotally connected to the first end 14 of the base member 12 and is movable between an operative position as shown in FIG. 1 and an inoperative position as shown in FIG. 2. When the handle is in its inoperative position, a number of pallets can be stacked on top of each other with the handle of the lower pallet fitting within the recess 28 of the pallet directly above, as shown in FIG. 7.

The pallet thus far described is constructed and functions essentially in the manner described in U.S. Pat. No. 5,799,585 invented by the present applicants. The entire disclosure of that prior patent is incorporated herein by reference. As more fully described in therein, the pallet of the prior patent includes a pair of fixed rails in the form of elongated steel beams that extend downwardly from the bottom of the base member between the first and second ends thereof. The elongated beams are spaced equally on either side of a longitudinal centerline of the base member and are preferably located about 900 mm from one another. The base member of the prior patent is supported on the elongated beams or rails.

As will be described more fully herein, the rails of the present invention are similar to the prior rails but are movable between an inoperative position wherein they are retracted into the lower face of the base member and an extended operative position wherein they extend downwardly from said lower face. As a result, the lower face of the base member is adapted to rest directly on a support surface when the rails are retracted. Much like the prior pallet, however, the rails support the base member on a support surface when they are extended.

Figure 5:
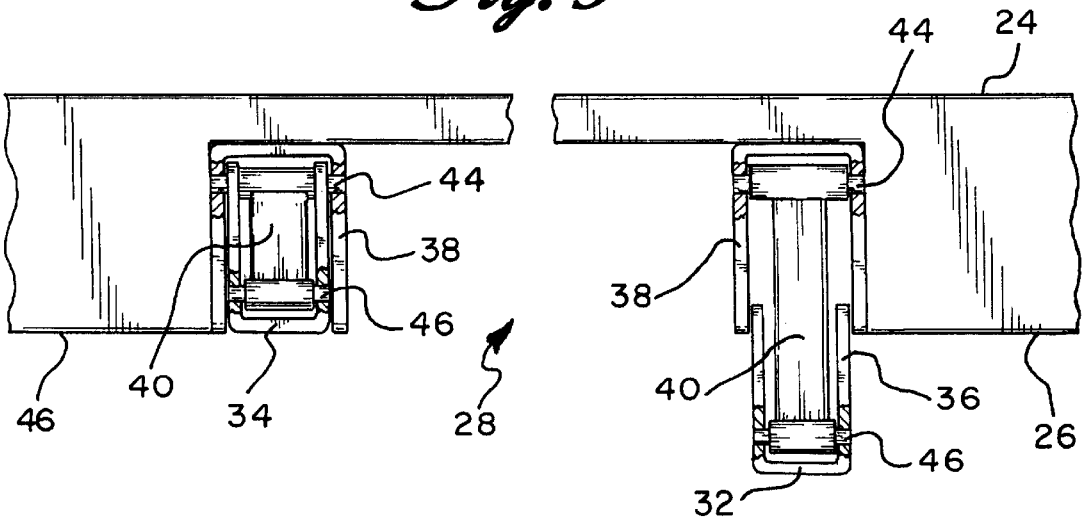
FIG. 5 is an end view of the pallet illustrating one of the rails in an extended position and the other rail in a retracted position.

FIG. 5 is an end view of the pallet 10 illustrating one of the rails 32 in an extended position and the other rail 34 in a retracted position. The two rails 32 and 34 are constructed in the same manner and operate the same way. Accordingly only one will be described, it being under stood that this description is equally applicable to the other rail.

The rails themselves are essentially formed of a steel U-shaped channel member 36 that extends substantially the entire length of the base member 12. Secured to the lower surface 26 of the base member 12 on either side of the recess 28 is an elongated inverted U-shaped channel member 38 that also extends substantially the entire length of the base member 12. The inside width of the channel member 38 is slightly greater than the outside width of the channel member 36. In this way, the channel member 38 functions as a pocket allowing the channel member 36 to move into and out of the same. That is, the channel member 36 can be moved downwardly out of the channel member 38 into its extended position as shown at the right in FIG. 5 wherein it functions as a rail. Alternatively, it can be retracted into the position shown at the left in FIG. 5.

Figure 4:
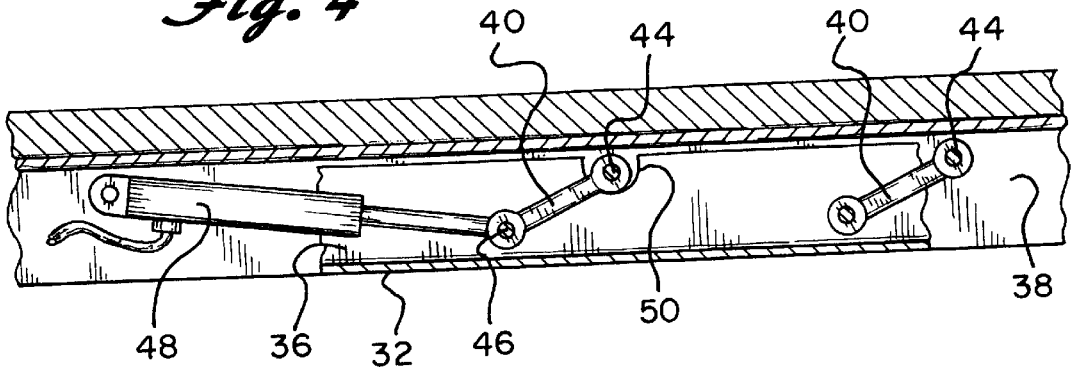
FIG. 4 is a sectional view illustrating the manner in which the rails of the invention are retracted.
Figure 3:
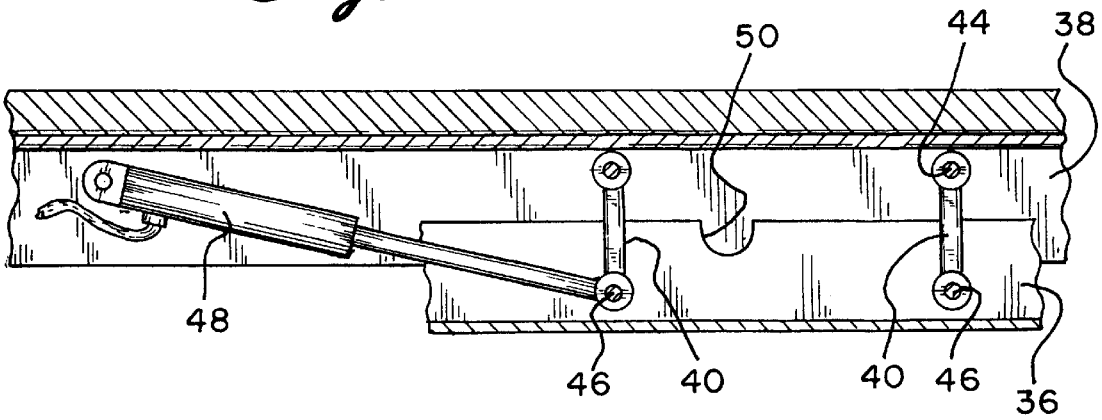
FIG. 3 is a sectional view illustrating the manner in which the rails of the invention are extended.

The manner in which the channel members 36 and 38 are interconnected for movement relative to each other is best illustrated in FIGS. 3, 4 and 5. A plurality of links 40 are located within the space between the channel members. The top of each link 40 is pivotally connected to the side walls of the channel member 38 as shown at 42. This is preferably done by forming the top of each link in the nature of a bearing and passing an axle such as 44 therethrough with the ends of the axle being supported by the side walls of the channel member 38. In a similar manner, the bottoms of each link 40 are pivotally connected to the side walls of the channel member 36 such as shown at 46. An hydraulic piston or ram 48 extending between the two channel members moves the two channel members relative to each other.

As shown best in FIGS. 3 and 4, when the hydraulic ram 48 is extended, the channel member 36 begins to move to the right and because of the links 40 pivots downwardly in an arcuate path until it is in its extended position as shown in FIG. 3. To retract the rail or channel member 36, the ram 48 is withdrawn. This causes the channel member 36 to move in the opposite arcuate direction until it rests within the channel member 38 as shown in FIG. 4. Appropriate cutouts such as shown at 50 are formed in the upper side walls of the channel member 36 so as to prevent interference with the axles 44 as the channel member moves into its retracted position.

Figure 6:
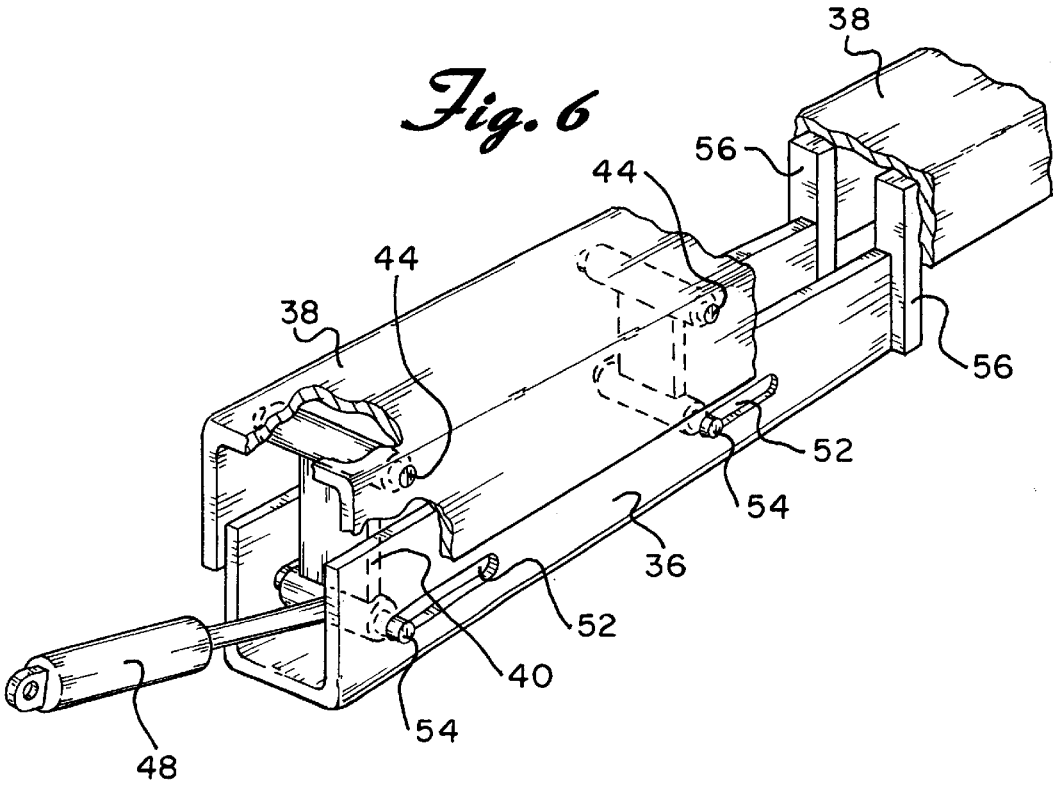
FIG. 6 is a perspective of a second embodiment of one of the extendible/retractable rails showing the operative components thereof.

A second arrangement for moving the channel members relative to each other is shown in FIG. 6. In this embodiment, a horizontal slot 52 is formed in the wall of the channel member 36 to accommodate the lower axle 54 of the link 40. The hydraulic ram 48 directly drives the lower end of the link 40 and as it moves, the axle 54 rides in the slot 52 thereby allowing the channel member 36 to move straight up and down rather than in an arcuate direction. The channel member 36 may be guided for up and down movement by one or more stop members 56 that prevent the channel member from moving forwardly or rearwardly.

The forgoing described methods for moving the rails up and down are merely illustrative. Substantially any means may be provided for this purpose. For example, a plurality of small hydraulic rams may be provided for directly moving the rails. Alternatively, a screw jack arrangement could be provided such as shown in FIGS. 9 and 10 of U.S. Pat. No. 4,911,318.

In the preferred embodiment, each of the rails has two openings formed therein such as shown at 58 and 60. These openings are aligned with each other thereby allowing the pallet to be readily lifted by a fork lift truck. Specifically, each time of the fork lift truck is passed through the aligned openings so that the truck can lift the pallet as more fully described in applicants prior patent discussed above. Obviously this can be done only when the rails are in their extended position.

The present invention may be embodied in other specific forms without departing from the spirit or essential attributes thereof and accordingly reference should be made to the appended claims rather than to the foregoing specification as indicating the scope of the invention.

We claim:

1. A shipping pallet with retractable rails comprising:

a rectangular planar base member having an upper face, a lower face, a first end, a second end, and two opposing side edges;

a pair of spaced apart elongated rails carried adjacent the lower face of said base member, said rails extending substantially the length of said base member and being located on either side of the center thereof, said rails being movable between an inoperative position wherein they are retracted into the lower face and an extended operative position wherein they extend downwardly from said lower face, the lower face of said base member being adapted to rest directly on a support surface when said rails are retracted and said rails supporting said base member on a support surface when said rails are extended, and means for moving said rails between said inoperative and said operative positions.

2. The shipping pallet as claimed in claim 1 wherein said moving means includes hydraulic means.

3. The shipping pallet as claimed in claim 2 wherein said moving means includes an hydraulic piston.

4. The shipping pallet as claimed in claim 1 wherein said lower surface of said base member includes a pair of elongated channel members and wherein said rails retract into said channel members.

5. The shipping pallet as claimed in claim 1 further including a handle member pivotally secured to said base member adjacent said first end.

6. The shipping pallet as claimed in claim 5 wherein said handle member is adapted to be pivoted from an inoperative position, wherein said handle member is folded on top of said base member, to an operative position, wherein said handle member extends upwardly from said base member, said handle member having a width which is less than the distance between said rails whereby when said handle member is in its inoperative position it can fit between the rails of a similarly constructed pallet stacked thereon.

7. The shipping pallet as claimed in claim 6 wherein said base member has a recess extending into said first end of said base member, said recess being defined by two side edges and a transverse edge and wherein said handle member is pivotally secured to said side edges.

8. The shipping pallet as claimed in claim 7 wherein said handle member includes a pair of converging arms, each of said converging arms being pivotally secured to said base member adjacent a different one of said side edges of said recess, said pair of arms being joined by a connecting segment.

9. The shipping pallet as claimed in claim 1 wherein each of said rails includes at least two spaced apart openings therein.

10. The shipping pallet as claimed in claim 7 wherein said handle member has a predetermined thickness and wherein said elongated rails extend downwardly from said base member when they are in their operative position a distance which is at least as great as the thickness of said handle member.

* * * * *